United States Patent [19]

Downs

[11] 4,356,880

[45] Nov. 2, 1982

[54] ACOUSTICAL REFLECTORS

[76] Inventor: James W. Downs, 3917 Villanova, Dallas, Tex. 75225

[21] Appl. No.: 172,649

[22] Filed: Jul. 28, 1980

[51] Int. Cl.[3] ..... E04B 1/99

[52] U.S. Cl. ..... 181/30; 181/286

[58] Field of Search ..... 181/30, 295, 289, 294, 181/175, 155, 156, 286

[56] References Cited

U.S. PATENT DOCUMENTS

| | | | |
|---|---|---|---|
| 1,854,542 | 4/1932 | Cooke | 181/30 |
| 2,064,911 | 12/1936 | Hayes | 181/175 X |
| 3,195,677 | 7/1965 | Hillery et al. | 181/175 |

FOREIGN PATENT DOCUMENTS

| | | | |
|---|---|---|---|
| 825516 | 3/1938 | France | 181/175 |
| 2371846 | 7/1978 | France | 181/30 |

*Primary Examiner*—Benjamin R. Fuller

*Attorney, Agent, or Firm*—Warren H. Kintzinger

[57] ABSTRACT

A sonic reflector comprising three mutually perpendicular walls of sound reflective material each of a generally right triangular shape. Plural arrays of such reflectors provide acoustical panels useful in assisting performers in monitoring their own performance on stage and in delivering enhanced sound to the audience. Plural reflector arrays have wide applications where it is desirable to return sound waves to the vicinity of the source.

27 Claims, 8 Drawing Figures

ACOUSTICAL REFLECTORS

Figure 1C:
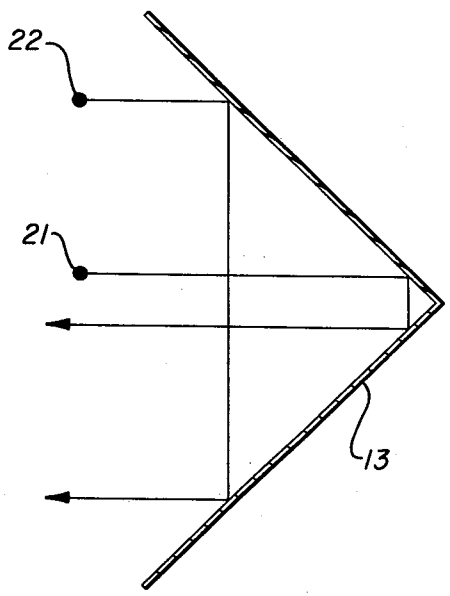

This invention relates generally to sonic reflector systems and, more particularly, to corner reflectors useful singly and in arrays for acoustical modification of performance areas and in sonic and ultrasonic systems.

In auditorium and stage or performing area designs, a principal, if not the primary, concern is the acoustical characteristics. Usually these acoustical characteristics are analyzed and engineered with a goal of transmitting the sound originating in a performing area to the audience area in an as life-like, uniform, and distortionless manner as possible. With the commonly used large flat baffles and sound reflectors, the sound is delivered to the audience with reasonable effectiveness but at the expense of the performer, who receives little or no "feedback" of sound. This is because the sound reflectors used tend to be dispersive so that most of the reflected sound is directed away from the performer and very little is reflected to him. Also sound absorptive materials are often used to prevent many sound reflections which would interfere with clear reception by the audience. Indeed, performances often suffer when a performer is unable to hear his performance well enough to judge it or to stay on the same pitch as other performers.

It is an object of the present invention to provide an acoustical reflector element which returns sound waves parallel to their originating path with a minimum of dispersion.

Another object is to provide acoustical reflector panels comprising an array of corner reflectors operating efficiently to return sound waves incident thereon to the vicinity of their source.

Still another object is to provide sound reflective systems for use in performing areas to reflect substantial amounts of sound back to a performer as well as past the performer and to the audience areas.

A further object is to provide an efficient sound reflective device for use in sonic and ultrasonic systems to return sound waves to a source on a path parallel to their incident path without the requirement for critical orientation or focusing reflectors.

Features of the invention useful in accomplishing the above objects include the formation of a "corner" sound reflector using three wall members of a material of sufficient hardness to reflect sound, such as wood, fiberboard, particle board or plastic. Each member is in the shape of a right triangle. The wall members are joined to each other along their shorter sides and are mutually perpendicular. Large reflective panels are formed by mounting several "corner" reflectors on a common support. Panels may also be formed by joining a number of corner reflectors together at the hypotenuse edges of their wall members to form a solid array of reflectors.

Specific embodiments representing what is currently considered the best mode of implementing the present invention are shown in the accompanying drawings.

Figure 1B:
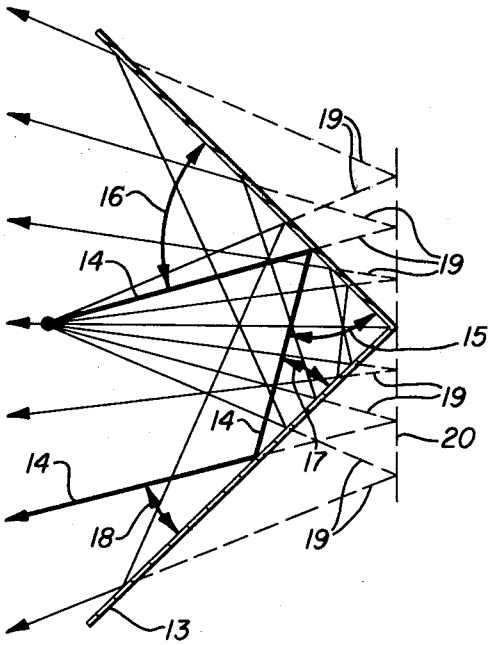
Figure 1A:
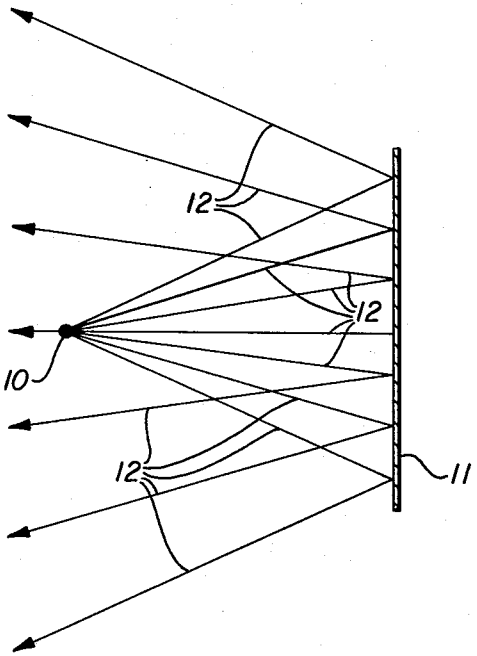
Figure 2:
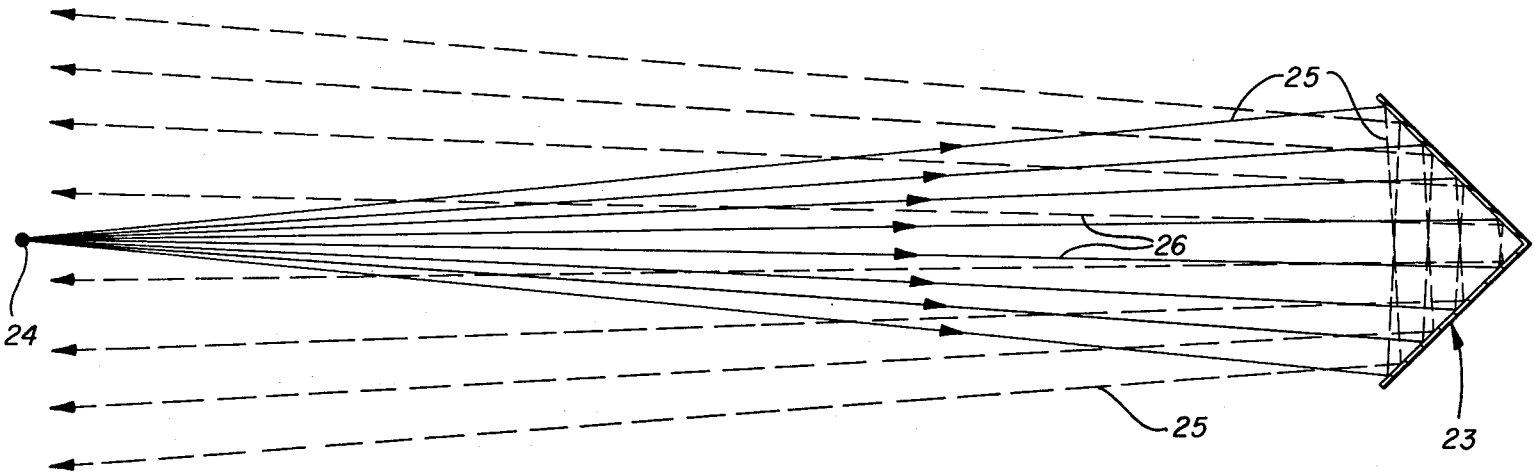
Figure 5:
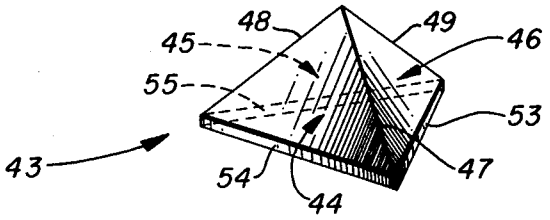
Figure 3:
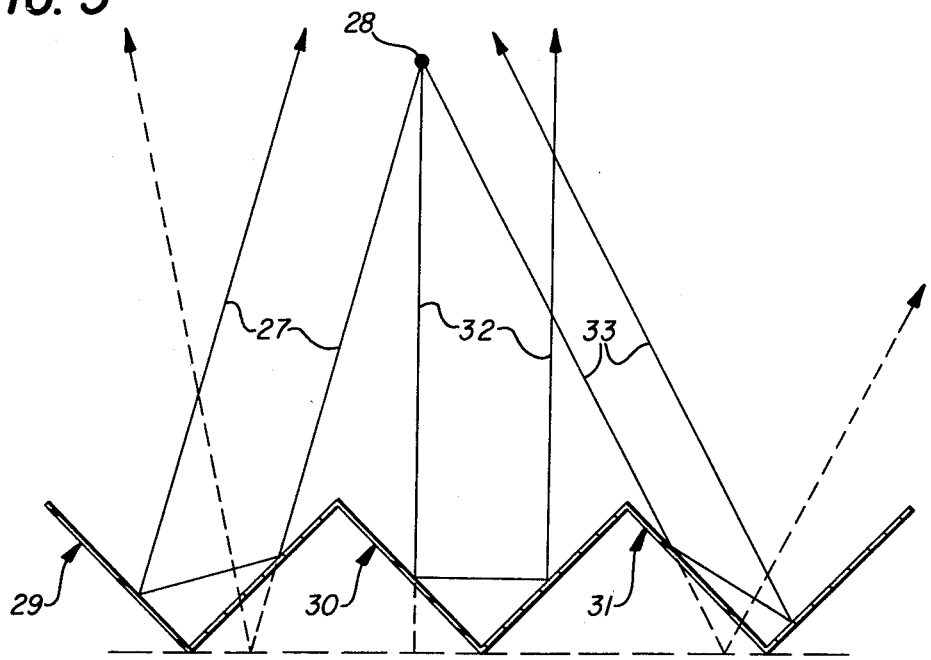
Figure 6:
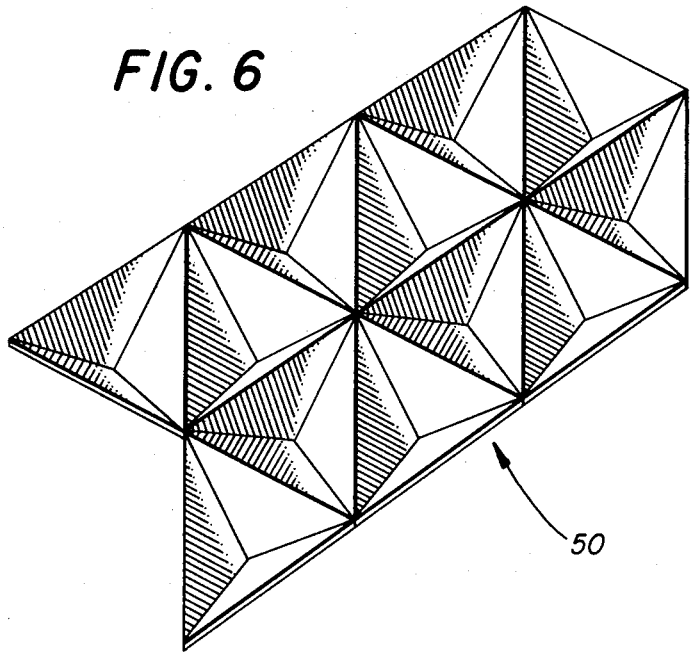
Figure 4:
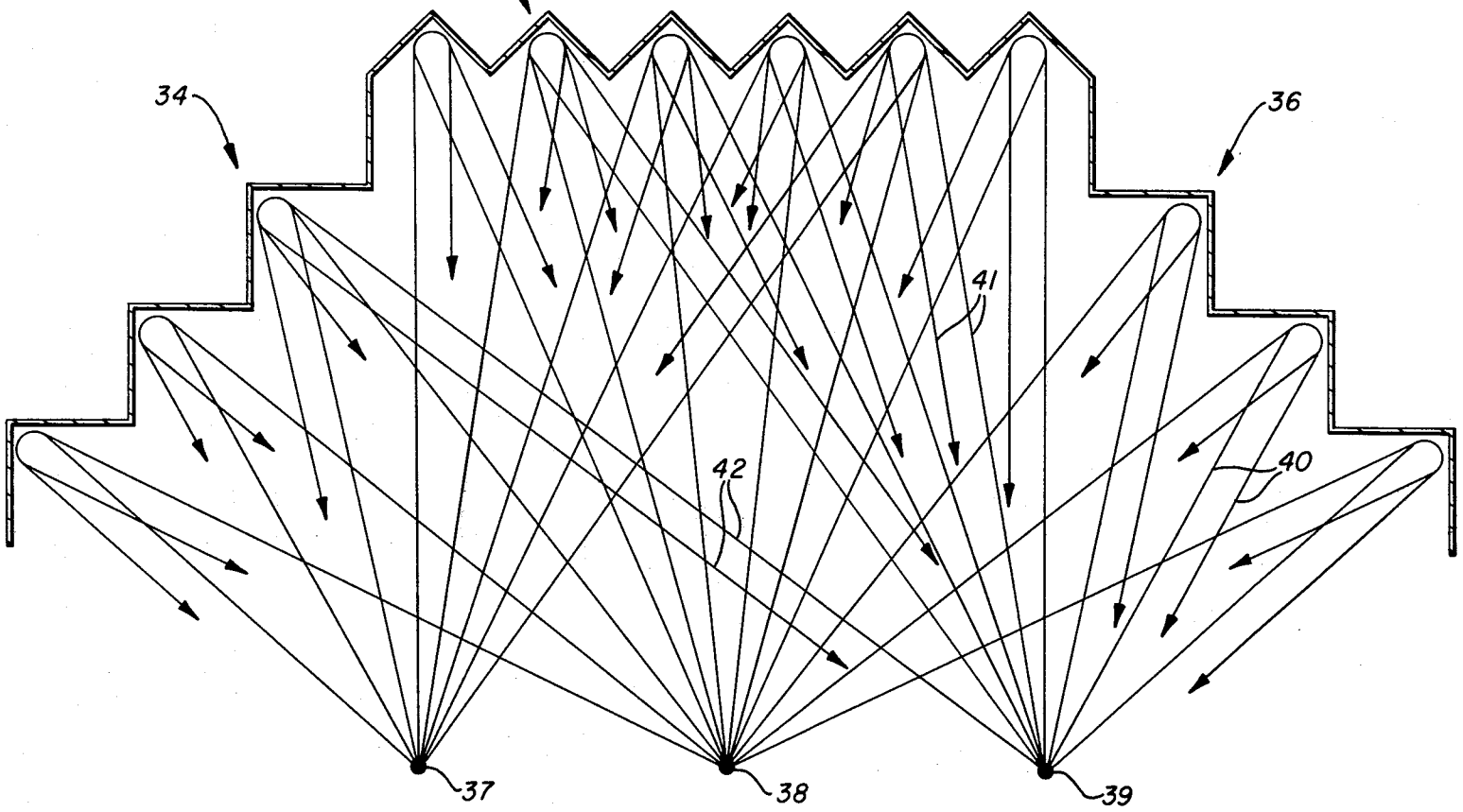

In the drawings:

FIGS. 1A–1C are diagrams illustrating sound wave reflective patterns from several types of reflecting elements;

FIG. 2, a diagram illustrating sound wave reflective patterns from a "corner" reflector of the type provided by the present invention;

FIG. 3, a diagram illustrating the sound wave reflective patterns from a panel element of multiple corner reflectors according to the present invention;

FIG. 4, a diagram illustrating the soundwave reflective patterns from a plural panel arrangement in a concert or performing area;

FIG. 5, a perspective view of one type of corner reflector according to the present invention; and FIG. 6, a perspective front view of a typical reflective panel comprising a plurality of corner reflectors according to the present invention.

Referring to the drawings:

The diagram, FIG. 1A, illustrates how sound eminating from a source 10 is dispersed when reflected from a reflector 11. As the ray patterns 12 show, sound from source 10 reflected from flat reflector 11 is not reflected to the vicinity of the source, (except for a small amount) since it follows the rule that the angle of reflection is equal to the angle of incidence. The diagram of FIG. 1B shows that a corner or angle reflector 13 which is large and relatively close to the source 10 produces a "double bounce" reflection with the sound returning along a parallel path. This is illustrated, for example, by ray path 14 which reflects from the upper side of reflector 13 at an angle 15 equal to its angle of incidence 16, then strikes the lower side of reflector 13 at an angle 17 and is reflected at an equal angle 18 and parallel to its original line of emination from the source. As indicated by the extended ray paths 19, shown in dashed lines, the reflection from reflector 13 is as dispensive of the sound as if it were reflected from a flat surface, as represented by dashed line 20.

FIG. 1C shows that some, but not a great amount, of sound from a source 21 located near the bisector of an angle of the reflector 13 is reflected to the vicinity of the source 21. Even less of the sound from a source 22 located well off the bisector line is reflected to the vicinity of that source. This then illustrates why performers often have the "worst-seat-in-the-house" as far as hearing their own performance.

The diagram of FIG. 2 illustrates that when a corner reflector 23 according to the present invention is smaller and at a relatively greater distance from a source 24, a much greater proportion of the total amount of sound reflected by the reflector is reflected to the close vicinity of the source 24. This is shown by ray paths 25 and 26 indicating that although there is some dispersion, even the sound reflected from the extremeties of reflector 23 returns to the relatively close vicinity to the source.

FIG. 3 shows by ray path 27 that even when a source 28 is located well off the centerline of the properly proportioned and distanced corner reflector 29 of the present invention a large proportion of the sound reflected is returned to the vicinity of the source. Thus it can be seen that when a number of reflectors according to the present invention are placed about a source 28, such as a performer, each contributes its own reflected sound to the vicinity of the source and the performer can hear his performance quite well. Ray paths 32 and 33 show respectively that reflections from reflector 30, whose centerline is nearer the source 28, and reflections from reflector 31, whose centerline is even further from the source, are returned to the vicinity of the source. It should be noted that it is not necessary that reflectors of the present invention be in any way connected together to perform in unison as described, nor are they required to be specifically focused. Indeed, focusing to return the sound to a particular spot would defeat one of the advantages produced by this invention, as will be illustrated in the following discussion.

In FIG. 4 there are shown, schematically, three panels 34, 35 and 36, each comprising a plural array of corner reflectors according to the present invention. The panels are placed as they might be used in the performance area or stage of a concert hall. Sources 37, 38 and 39 may represent several individual sources, such as instruments in an orchestra, for example. As shown by the ray paths, each reflector in each panel returns the sounds from each source to the vicinity of that source but reflects very little, if any, of the sounds of one source to the vicinity of another source. See, for example, ray paths 40, 41 and 42.

There is another benefit in the use of corner reflectors besides allowing the performers to hear themselves. The reflected sound, after it passes through the immediate area of the source continues toward the audience, retaining its directional characteristic since the reflected sound and original sound are both coming from the same area as far as the audience is concerned. This means that there will be better separation between instruments, thus enhancing the "stereo" effect that a live performance should have.

At this point it should be noted that although the illustrating diagrams of the drawings have been limited to showing the reflective properties of the reflectors of the present invention in only two dimensions and from only two plane surfaces at right angles with each, the actual corner reflectors comprise three plane surfaces which are mutually perpendicular and reflect the sound in a parallel path in the three dimensional sense. Thus sound striking a three-surfaced corner reflector of the present invention from above and to the right of the reflector will be reflected above and to the right of the reflector.

FIG. 5 is a perspective view of a three-surfaced corner reflector 43 according to the present invention. As can be seen, each of the surfaces, 44, 45 and 46 of the reflector of FIG. 5 comprises on isosceles right triangle with edges 47, 48 and 49 all being of equal length. The edges 53, 54 and 55 are each 2 times the length of edges 47, 48 or 49. It has been found that if the wavelength of the sound striking such a reflector is very long compared to a length of edges 53,54 and 55, the reflector is much less effective. However, the reflector is very efficient in returning sound of a relatively short wavelength, compared to this edge length, in a parallel path back to its source. The efficiency of reflection begins to diminish when the sound energy wavelength becomes longer than about twice the length of the edges 53, 54 and 55.

Although a corner reflector in the form of a regular triangle-based pyramid as illustrated in FIG. 5 is very convenient for many purposes, especially in constructing panel arrays, the corner reflectors of this invention are not limited to this particular structure. For example, effective and efficient reflectors may have two walls which are 30°–60° right triangles with the third wall an isosceles right triangle. Other wall shapes are equally effective so long as the three walls are mutually perpendicular.

When the base plane of the corner reflector of the present invention, i.e., the plane of edges 53, 54 and 55 forms an equilateral triangle, a number of such reflectors can be joined at their edges to form arrays in panels having a number of different shapes, such as hexagons, triangles, parallelograms, diamonds, and trapezoids. FIG. 6 shows such a panel array 50 of twelve corner reflector elements in an elongated shape. The actual surface area of a corner reflector or an array panel of corner reflectors is 1.7 times the effective frontal area but because of the angular nature of the structure it is possible in the construction of an array to use material much thinner than would be required for a flat reflector. For example, by using $\frac{3}{8}''$ or $\frac{1}{4}''$ thick material, a corner reflector can be constructed that will be more rigid and lighter than a flat reflective panel constucted of $\frac{3}{4}''$ thick material having the same frontal area. As previously noted, the advantages of the corner reflector are diminished if the size of the individual reflector is very large compared to its distance from the source. Although there is no specific ratio of reflector size to source distance at which results can be said to become unacceptable, it has been found that excellent results are obtained when the opening of each individual reflector constitutes an included angle of 30° or less at the distance from the source at which it is to be used. Also, as can be seen from FIG. 2, the greater the number of reflectors included within a panel the more pronounced will be the reflection of each sound to its source, within limits of course.

It will be obvious that corner reflectors of forms other than that shown in FIG. 5 can also be connected in panel arrays. It is not necessary, of course, that the corner reflectors in a panel array be directly connected to each other since effective panels can be constructed by mounting a number of corner reflectors on a common support, which may be merely a support framework or a more solid wall-like structure. Further, in the sense used herein a panel array may consist of a number of corner reflectors each mounted on an individual support but arranged in such a manner as to provide cooperative or reinforcing reflecting effect. Further, the corner reflectors need not be mounted in a common plane but may be in "staggered" fashion in a curved, arcuate, or even spherical "surface".

The optimum design of a corner reflector array panel of the type shown in FIG. 5, or of any of the other types mentioned, will depend on the lowest frequency of interest to be reflected, relative magnitude of reflected and original sounds at a receiving position, and the distance between the source and the reflector, among other factors.

In his experiments the applicant has found that efficient and effective reflector panels for concert stages can be easily built from the 4'×8' sheets which are the standard size for plywood, fiberboard, particle board and other such materials. Nine such sheets will produce a panel of twelve reflectors of appropriate size. Each wall of each reflector will be one-half of a four foot square of material (cut on the diagonal from opposite corners). Each edge of each opening then would be about 5–7 feet long.

If it is remembered that sound will be returned in a direct line from the corner reflectors past the sources, it will be obvious that if the reflectors are not in a plane that is approximately perpendicular to the seating plane of the audience the reflections will be lost to the audience. For example, a panel of corner reflectors suspended above or above and behind the stage will return sound to the individual performers and then into the floor. It has been found that for maximum benefit to an audience in the use of corner reflector array panels such as shown in FIG. 5, they should start about three feet above the stage floor and rise to a height of about eight to ten feet above the floor of the stage. A twelve reflector array made from 4×8 feet sheets of materials would be approximately 19½ feet long and 9½ feet high, a size which is quite close to the size to produce maximum audience benefit as outlined above when properly placed.

Of course, the uses of the corner reflectors and arrays of the present invention are not limited to concert hall or auditorium acoustic improvements but extend to many other systems making use of sonic energy reflection. For example, sonic or ultrasonic distance measuring devices, as for example, ultrasonic surveyor's "chain" indicating distances by accurately measuring the travel time of a sonic signal reflected back to the source. Such devices operate more effectively when the transmitted signal is focused in the direction of a reflector device, and even more effectively when a focusing reflector is used and both the transmitter and reflector are accurately directed. A small array of corner reflectors according to the present invention, optimized for the sonic or ultrasonic frequency used may be very effectively used in such systems since the directional orientation of the reflector array is not at all critical. The reflection path is always parallel to the path of the source signal no matter what the angle of incidence. For such use generally multisided, circular or even spherical array would eliminate the need for any directional orientation.

A generally circular or spherical array acts as a "passive" transponder to sound signals in either air or water. Such arrays may be used on land, in water or under water, as bouys or beacons to indicate water channels, locations of navigation dangers or other areas in need of marking in darkness, fog, or other conditions impairing visual location.

Inasmuch as the size of each corner reflector determines its frequency response characteristic, reflective array responders can be used in size combinations to provide identifying characteristics. For example, an array having a reflective response that begins to decline markedly below a frequency of about 50 kilohertz could be used together with an array having a response that declines markedly below about 200 kilohertz. Such a combination would produce an identifying characteristic response when illuminated by an ultrasonic signal from a transmitter that "sweeps" through a frequency band of interest.

It should be kept in mind that in designing the corner reflectors of the present invention for a specific purpose dimensions and acceptable tolerances must take into account, among other things, the absolute frequency of interest, the speed and thus the wavelength of sound in the environment or medium in which it is to be used. For example, sound travels over four times as fast in fresh water as in air and even faster in seawater. Sound travels at a slower speed at higher elevations, thus the wavelength of a given frequency is shorter at 10,000 feet elevation than at sea level.

Although this invention has been described and illustrated herein with respect to certain embodiments, it is to be realized that various changes and modifications may be made thereto without departing from the essential contributions to the art embodied in the teachings hereof.

I claim:

1. A sonic reflector system comprising: at least one panel including a plurality of similarly constructed reflectors with each reflector having three mutually perpendicular walls of sound reflective material, with each wall having the general shape of a right triangle with its hypotenuse edge lying in the same plane as the hypotenuse edge of each of the other two walls.

2. The sonic reflector system of claim 1, wherein each of said walls is of the general shape of a right isosceles triangle.

3. The sonic reflector system of claim 2, wherein the hypotenuse edge of each wall is about one-half the length of the longest sonic wavelength of interest.

4. The sonic reflector system of any of claims 1, 2, or 3, wherein said reflector is positioned with respect to a source of sonic waves so as to reflect sonic waves from said source back to the vicinity of said source, and is located at a distance from said source so as to occupy an included angle from said source of no more than 90°.

5. The sonic reflector system of claim 1, wherein the hypotenuse edges of all of said walls of said plurality of similarly constructed reflectors lie in a common plane.

6. The sonic reflector system of claim 5, wherein a hypotenuse edge of a wall of at least one reflector is common to a hypotenuse edge of a wall of at least one other reflector of said panel.

7. The sonic reflector system of claim 1, wherein a hypotenuse edge of at least one wall of each reflector is common to a hypotenuse edge of a wall of at least one other reflector in said panel.

8. The sonic reflector system of claim 1, wherein all of said reflectors are of essentially the same size.

9. The sonic reflector system of claim 1, wherein said reflectors are of at least two different sizes.

10. The sonic reflector system of claim 1, wherein said panel is arcuate.

11. The sonic reflector system of claim 1, wherein said panel is at least partially essentially spherical.

12. The sonic reflector system of claim 6, wherein a hypotenuse edge of at least one reflector is common to a hypotenuse edge of at least one other reflector of the panel.

13. The sonic reflector system of claim 6, wherein a hypotenuse edge of each reflector is common to a hypotenuse edge of at least one other reflector in said panel.

14. The sonic reflector system of claim 10, wherein all of said reflectors are essentially the same size.

15. The sonic reflector system of claim 10, wherein said reflectors are of at least two different sizes.

16. The sonic reflector system of claim 11, wherein all of said reflectors are of essentially the same size.

17. The sonic reflector system of claim 11, wherein said reflectors are of at least two different sizes.

18. The sonic reflector system of claim 13, wherein all of said reflectors are of essentially the same size.

19. The sonic reflector system of claim 13, wherein said reflectors are of at least two different sizes.

20. In a performance area adjacent an audience area; at least one sound reflector panel positioned on a side of said performance area opposite a substantial portion of said audience area; said panel comprising a plurality of corner reflectors each having three mutually perpendicular walls of sound reflective material; said corner reflectors having their open ends directed generally toward said audience area whereby substantial portions of sound waves to said panel from a source in said performance area are reflected by said plurality of corner reflectors through vicinity of said source to said audience area.

21. The arrangement defined in claim 20, wherein there are a plurality of said sound reflector panels.

22. The arrangement defined in claim 21, wherein each of said reflector panels is facing essentially toward the middle of said performance area.

23. The arrangement defined in claim 20, wherein said at least one panel is arcuate.

24. The arrangement defined in any of claims 20, 21 or 22, wherein all of said corner reflectors of each panel have their edges defining the open ends lying in a common plane.

25. The arrangement defined in any of claims 20, 21, 22 or 23, wherein all of said corner reflectors in each panel are of the same size.

26. The arrangement defined in claim 26, wherein at least one corner reflector in each panel has an open end edge in common with one other corner reflector in that panel.

27. The arrangement defined in claim 25, wherein each corner reflector in each panel has at least one open edge in common with at least one other corner reflector on the same panel.

* * * * *